US007931250B2

(12) United States Patent
Vappula

(10) Patent No.: US 7,931,250 B2
(45) Date of Patent: Apr. 26, 2011

(54) SIDEWALL CONSTRUCTION OF A CASTING MOLD

(75) Inventor: Kari Vappula, Toijala (FI)

(73) Assignee: Elematic Oy AB, Toijala (FI)

( * ) Notice: Subject to any disclaimer, the term of this patent is extended or adjusted under 35 U.S.C. 154(b) by 724 days.

(21) Appl. No.: 11/892,795

(22) Filed: Aug. 27, 2007

(65) Prior Publication Data

US 2008/0315067 A1 Dec. 25, 2008

(30) Foreign Application Priority Data

Sep. 13, 2006 (FI) ..... 20060816

(51) Int. Cl.
*E04G 9/06* (2006.01)

(52) U.S. Cl. ..... 249/219.1; 249/120; 249/135; 249/139; 249/169; 249/193; 425/3; 425/DIG. 33

(58) Field of Classification Search ..... 249/102, 249/120, 139, 160, 163, 167–171, 193, 205, 249/187.1, 219.1; 425/3, DIG. 33; 52/396.04
See application file for complete search history.

(56) References Cited

U.S. PATENT DOCUMENTS

| | | | | |
|---|---|---|---|---|
| 3,385,557 A | | 5/1968 | Rambelle | |
| 4,624,440 A | * | 11/1986 | Buchler | 249/194 |
| 4,709,899 A | * | 12/1987 | Kajioka et al. | 249/20 |
| 5,219,473 A | | 6/1993 | Sandwith | |
| 5,277,396 A | * | 1/1994 | Vappula | 249/65 |
| 5,368,272 A | * | 11/1994 | Badstieber | 249/192 |
| 5,522,579 A | * | 6/1996 | Rock | 249/219.1 |
| 6,276,657 B1 | * | 8/2001 | Vappula | 249/163 |
| 2005/0116131 A1 | | 6/2005 | Samuel | |

FOREIGN PATENT DOCUMENTS

| | | | |
|---|---|---|---|
| DE | 4412753 | | 10/1995 |
| EP | 0 048 468 | A1 * | 3/1982 |
| EP | 075917 | A1 | 9/1982 |
| EP | 0462771 | A1 | 12/1991 |
| NZ | 508434 | | 3/2002 |

OTHER PUBLICATIONS

Translation of EP 0 048 468 A1.*
Finnish Search Report, Jun. 19, 2007.
Examination Report issued in New Zealand Patent Application No. 13719 on Sep. 5, 2007.

* cited by examiner

*Primary Examiner* — Joseph S Del Sole
*Assistant Examiner* — Dimple Bodawala
(74) *Attorney, Agent, or Firm* — Buchanan Ingersoll & Rooney PC

(57) ABSTRACT

A sidewall construction for casting concrete elements, said sidewall construction comprising a mold surface plate (4) defining the surface of the product to be cast and a support construction (1, 2, 3), where the mold surface plate is fixed to, whereby the support construction is formed of two horizontal aluminum profiles (1, 2) and of at least one vertical aluminum profile (3) connecting the same.

20 Claims, 7 Drawing Sheets

SIDEWALL CONSTRUCTION OF A CASTING MOLD

BACKGROUND

1. Field

Disclosed herein is a sidewall construction of a casting mold to be used in casting of concrete elements and being fixed to the casting bed by means of magnets.

2. Description of Related Art

Detachable sidewall constructions of casting molds for elements cast of concrete are known in the art, said sidewall constructions being equipped with different fixing solutions. The sidewalls can be positioned to the casting bed at desired places, depending on the size and form of the product to be cast.

When casting wall elements of concrete, the flat mold to be used is in general a table or a tipping mold equipped with sidewalls. A casting machine moves above the table and batches the concrete mix to the mold. After the concrete is hardened, the table is tipped about a tilting axle provided on one side of the table, into an almost upright position, the sidewall of the mold ending up to be the uppermost will be removed, and the element is lifted away from the table using lugs provided on its sides. The position of the upper sidewall must be movable depending on the size of the element to be cast, and for that purpose, removable sidewalls can be used. By means of removable and adjustable sidewall parts also door or window openings can be formed to the element in desired places.

The use of magnets for fastening removable sidewalls of the mold is known in the art, and they are especially suitable for fixing a sidewall as they attach to the flat steel surface of the mold. To provide a strong attachment of the sidewall, strong magnets must be used effecting a bond strength of e.g. 15 kN. European Patent publication EP-A-1 075 917 discloses a magnet unit fixing to the counter part provided to the sidewall through an oblique protrusion or jaw of its front surface attaching to the respective oblique groove of the counter part. The front surface of the magnet unit is manufactured so that it is precisely in the angle of 90° C. with respect to the casting bed, when the magnet unit is fixed to the sidewall, whereby the front surface, due to the wedging effect the fixing system is characterized of, attaches to the back surface of the sidewall and keeps the sidewall always vertical. The magnet unit of EP-A-1 075 917 is provided with a tillable magnet that in its lower position can be fixed to the casting bed or turned up in the readiness position.

In addition, the casting bed usually comprises immovable lower and end walls at the edges of the casting bed, said walls being fixed by means of hinges to the casting bed. These sidewalls fixed to the casting bed with hinges have a heavy construction, and it is labour-consuming to remove them from the casting bed and to change them. It is not possible to form different through-holes required for these sidewalls e.g. by the reinforcing without breaking the side molds. And because the sizes of the production runs of the elements to be cast are very small, the forms of the elements to be cast must be changed frequently, whereby the sidewall sizes of the casting mold must be correspondingly changed. For these reasons the casting molds made of wood and veneer are increasingly used, causing big material consumption due to the small production runs.

SUMMARY

In the sidewall construction of the casting bed described herein, the sidewall of the casting mold is formed of an easily convertible frame formed of aluminium profiles, whereby an easily changeable surface placed against the cast is attached to the frame.

By means of the solution described herein, a convertible sidewall construction for different production runs can be easily and economically provided. In addition, the sidewall construction according to the invention is simple and light-weight and easily cleanable.

More specifically, the sidewall construction described herein comprises: a sidewall construction for casting concrete elements, said sidewall construction comprising:

a mold surface plate defining a surface of a concrete element to be cast; and a support construction, wherein the mold surface plate is fixed to the support construction, and, wherein the support construction comprises: two horizontal aluminium profiles each having an opposing inner surface and at least one vertical aluminium profile connecting and extending between said opposing inner surfaces of the two horizontal aluminium profiles.

BRIEF DESCRIPTION OF DRAWINGS

The solution described herein will be described by way of example in more detail in the following, with reference to the enclosed drawings, wherein.

DETAILED DESCRIPTION OF SPECIFIC EMBODIMENTS

Figure 1:
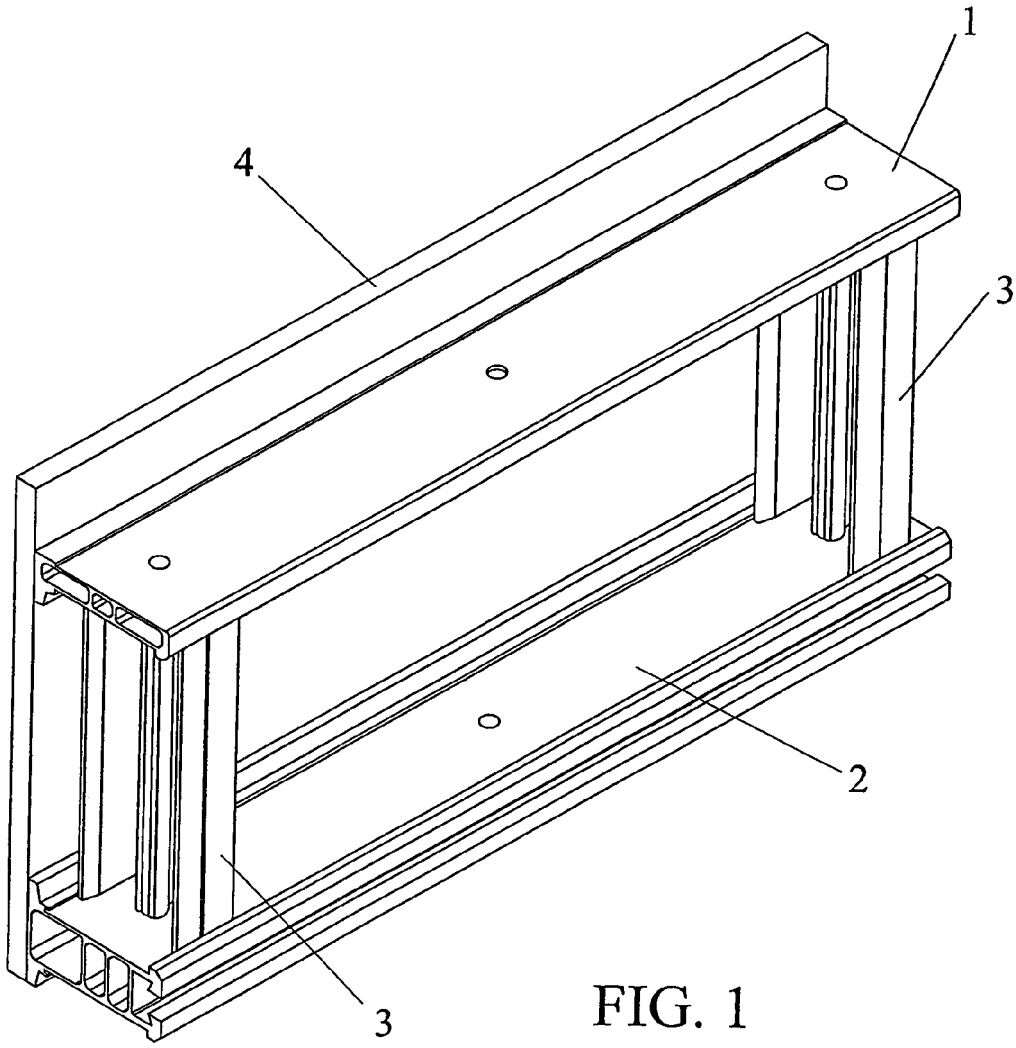
FIG. 1 shows a schematic view of one sidewall construction of a casting mold according to embodiments described herein.

The sidewall construction embodiment shown in FIG. 1 comprises a support construction including two horizontal aluminium profiles 1 and 2 and vertical aluminium profiles 3 connecting those. The support construction is fixed to a mold surface plate 4 setting against the product to be cast.

Horizontal aluminium profiles 1 and 2 are advantageously fixed to the vertical aluminium profiles 3 by means of coarse threaded bolts or screws (not shown in FIG. 1), whereby the joint is robust and the joint can be easily loosened e.g. for cleaning. When using said coarse threaded bolts, it is also not necessary to form threads to the vertical aluminium profiles, but the threads of the screw bite into the aluminium of the profile.

The vertical aluminium profiles 3 are preferably formed so that their depth in the transversal direction of the sidewall construction is adequate to provide an adequate supporting effect to the upper horizontal aluminium profile 1, when the casting mold equipped with said sidewall constructions if filled with concrete mass. The depth of the vertical aluminium profile 3 in the longitudinal direction of the sidewall construction is determined based mainly on adequate internal stiffness of the support construction. The depth of the horizontal aluminium profiles 1 and 2 in the transversal direction of the sidewall construction is determined by the form of the vertical aluminium profiles. The side construction is fixed to the casting bed through the lower horizontal aluminium profile 2.

The aluminium profiles 1, 2 and 3 forming the support construction of the sidewall construction are advantageously sold as piece-goods, whereby the sidewall construction can be easily manufactured to desired lengths and heights by cutting the profiles to pieces of desired length. In the example of FIG. 1 the mold surface plate is made of wood or veneer.

The sidewall construction of a casting mold according to the embodiment shown in FIG. 1 is easily made, lightweight and economical. In addition, it is easily convertible according to the needs of different production runs.

Figure 2:
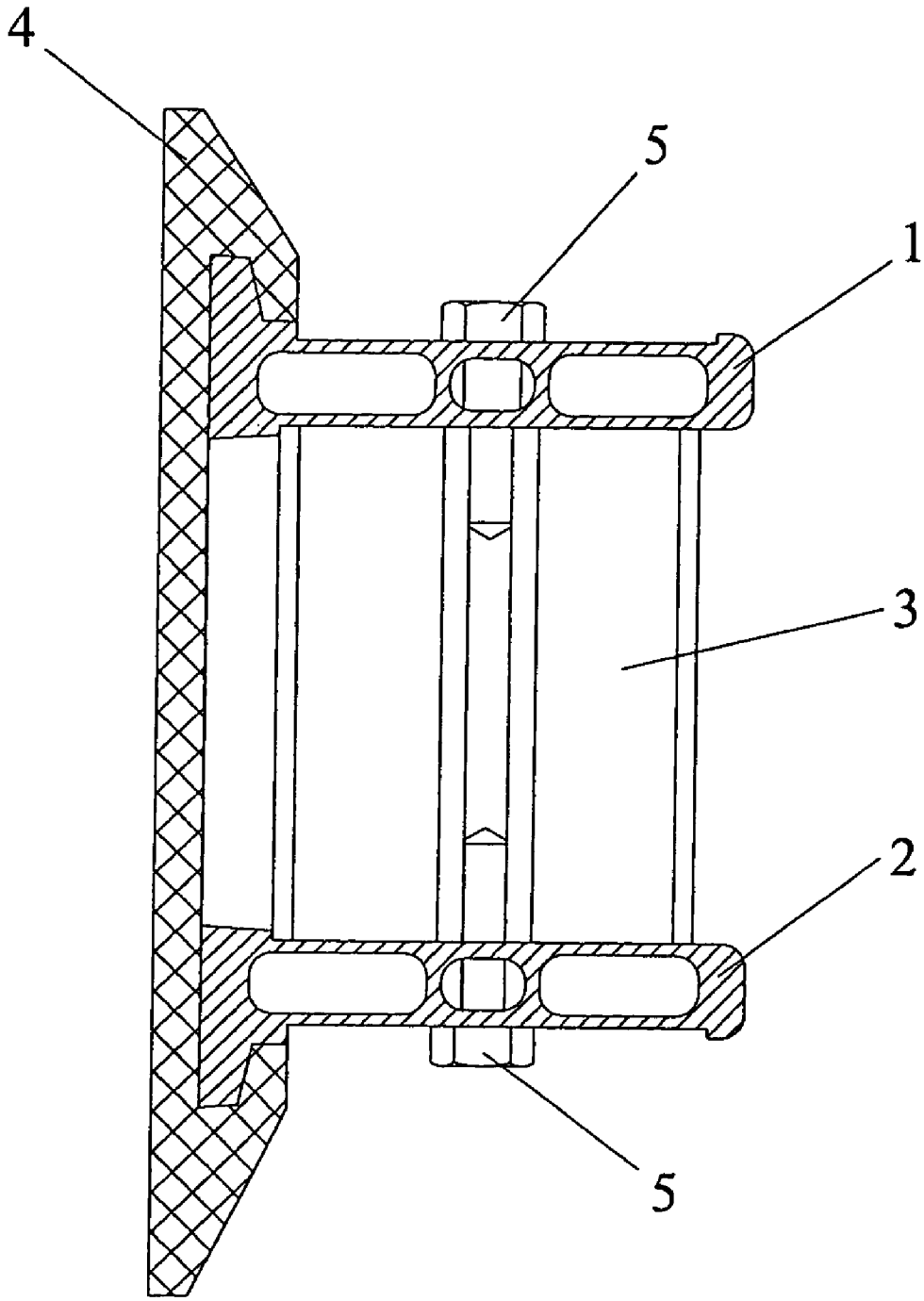
FIGS. 2-5, 6A and 6B show schematic views of cross sections of alternative embodiments of the side wall construction of the casting mold according to embodiments described herein.

FIG. 2 shows a cross-sectional view of one alternative sidewall construction of a casting mold described herein, comprising an upper and a lower horizontal aluminium profile 1 and 2, a vertical aluminium profile 3 connecting those and a mold surface plate 4. The figure also shows the coarse threaded bolts 5 fixing the vertical aluminium profile 3 to the upper and lower aluminium profiles 1 and 2.

In the solution of FIG. 2, the mold surface plate 4 is manufactured of plastic, the upper and lower parts thereof being provided with grooves adapted to receive the protrusions formed to the respective edges of the upper and lower aluminium profiles 1 and 2 setting against the mold surface plate.

With the solution according to FIG. 2, a simple and easily demountable connection system is provided between the support construction formed by the aluminium profiles 1, 2 and 3 of the sidewall construction and the mold surface plate 4, said system significantly facilitating and speeding up the mounting and cleaning of the sidewall construction. In addition, the described sidewall construction is lightweight and easily convertible for different molds in short production runs.

Figure 3:
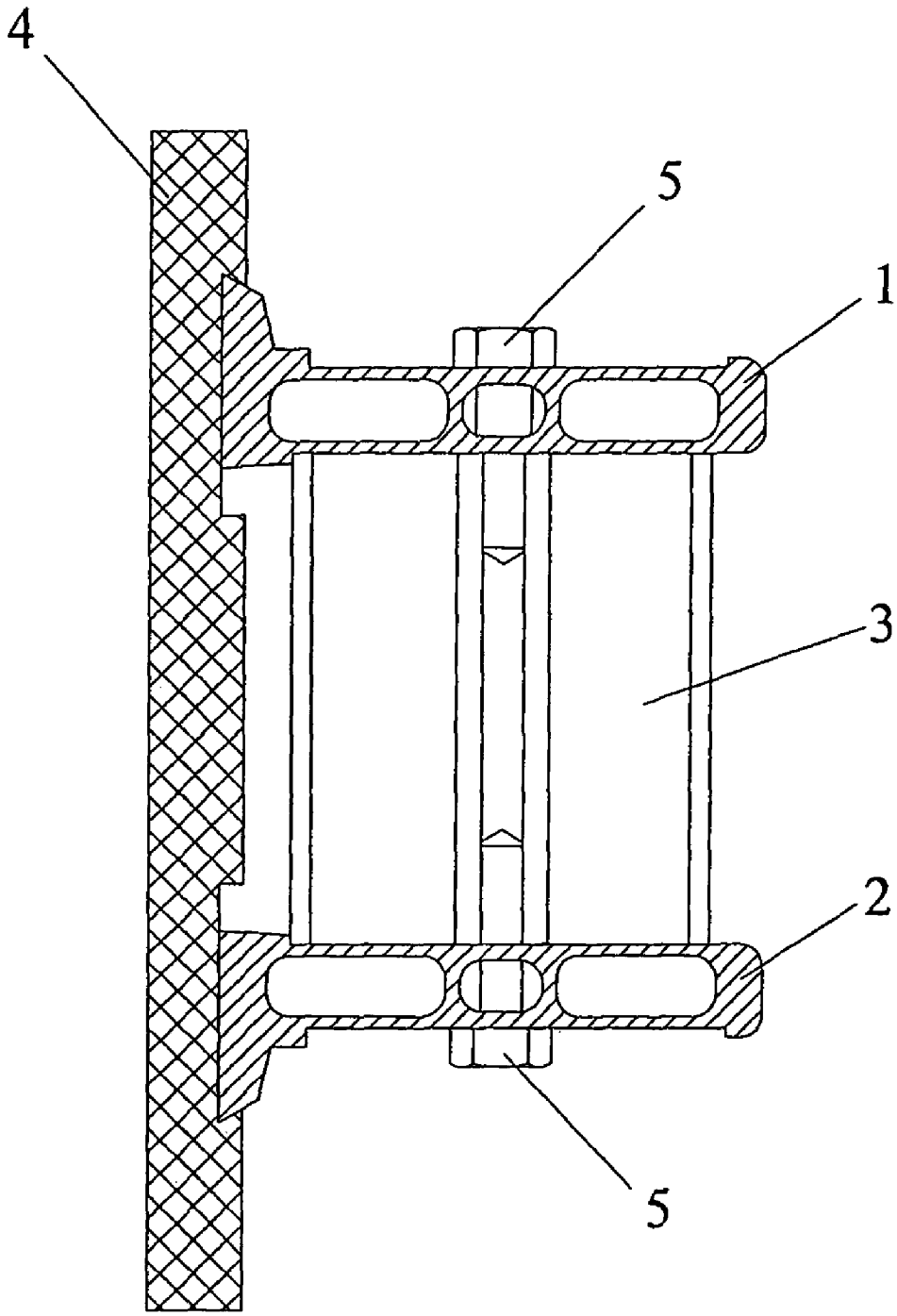

FIG. 3 shows an alternative embodiment of the sidewall construction of a casting mold described herein, wherein the support construction formed of the aluminium profiles 1, 2 and 3 and the coarse threaded bolts 5 is also fixed to a plastic mold surface plate 4.

The solution of FIG. 3 makes it possible to use a usual plastic plate as mold surface plate, whereby the plastic plate, when forming a mold surface plate, is cut to predetermined outer dimensions and grooves are formed onto the back surface thereof for fixing to the support construction. This kind of a solution further enhances the convertibility and economic efficiency of the sidewall construction described herein.

Figure 4:
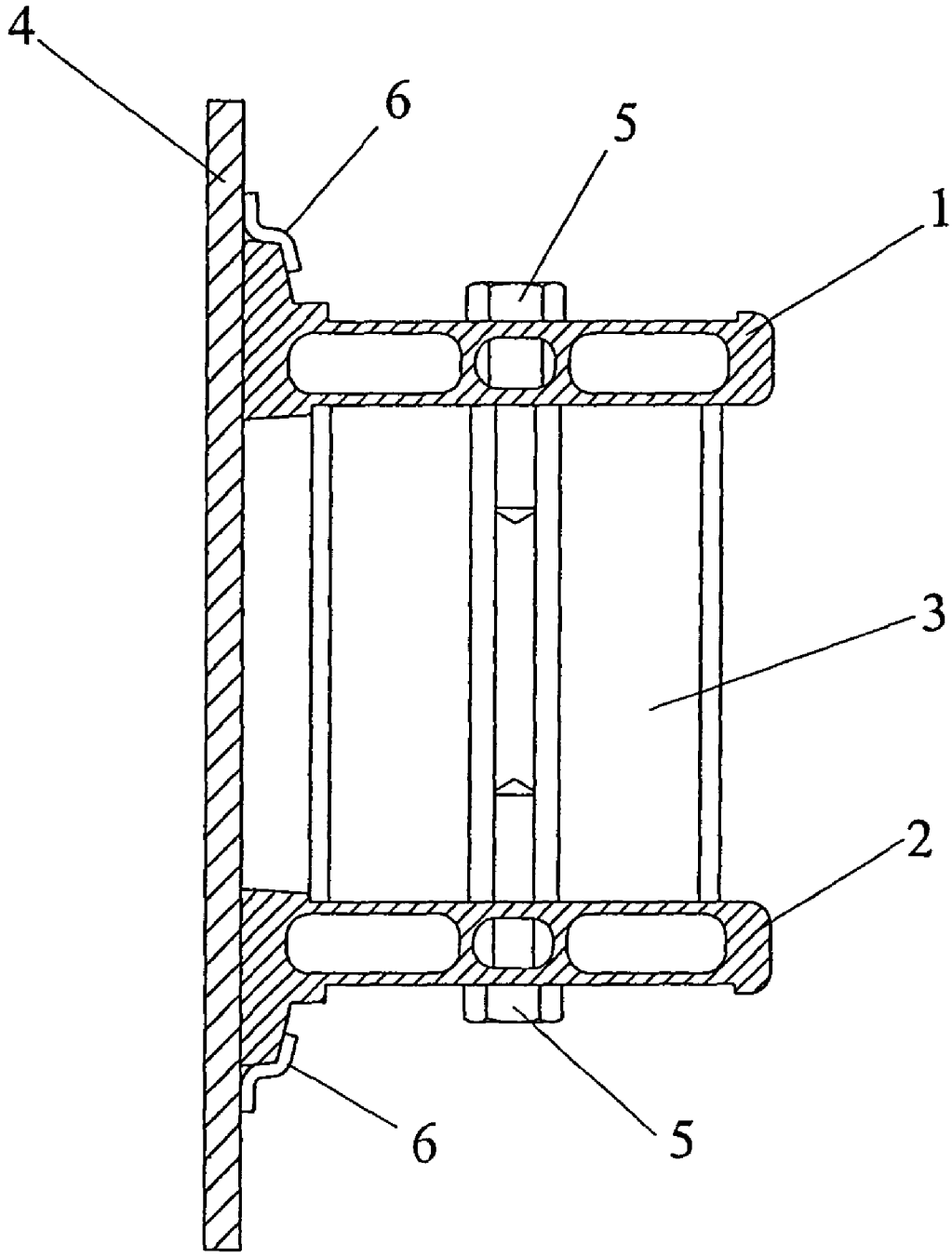

FIG. 4 shows an alternative embodiment of the sidewall construction described herein, comprising a support construction formed of aluminium profiles 1, 2 and 3 and coarse threaded bolts 5, and a mold surface plate 4 fixed to the support construction.

In the example of FIG. 4, the mold surface plate 4 is formed of a metal plate like steel plate, having clamps 6 attached e.g. by welding for fixing the support construction. As shown in the figure, said clamps 6 form grooves to the back wall of the mold surface plate 4, where the protrusions formed to the edges of the upper and lower horizontal aluminium profile 1 and 2 set, said edges setting against the back wall of the mold surface plate 4.

Figure 5:
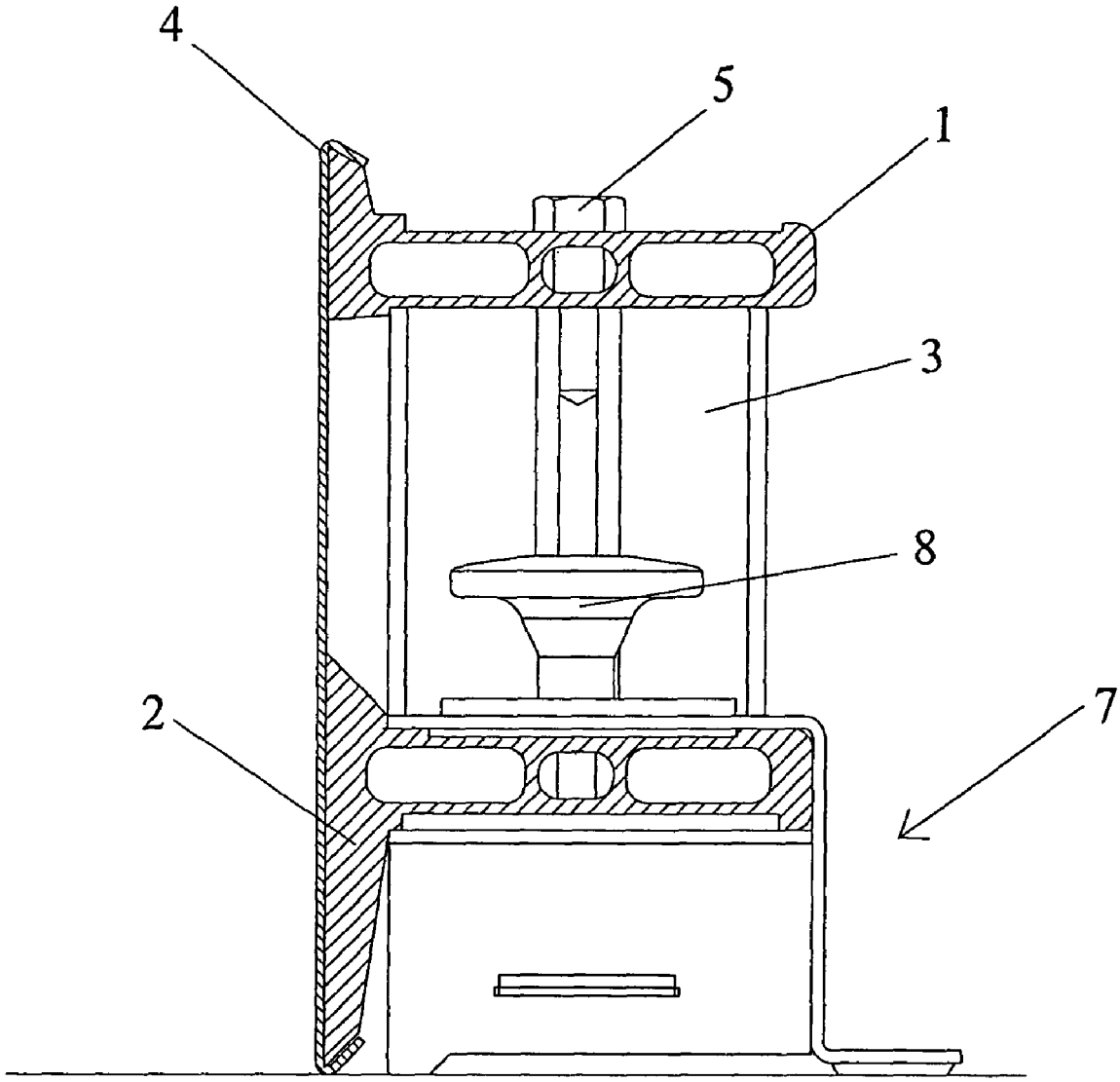

FIG. 5 shows an alternative embodiment of the sidewall construction described herein, comprising a support construction formed of aluminium profiles 1, 2 and 3 and of coarse threaded bolts 5, and a mold surface plate 4 fixed to the support construction.

In the example of FIG. 5, the mold surface plate 4 is formed of a metal sheet having its ends bent towards the back wall of the mold surface plate, whereby grooves are formed to the upper and lower edges of the mold surface plate for the protrusions of the upper and lower horizontal aluminium profiles 1 and 2. The bends can also be formed advantageously to the mold surface plate 4 so that the mold surface plate will be strained between the tongues of the horizontal aluminium profiles 1 and 2, thus securing that the mold surface plate 4 will be correctly positioned and kept in place. In addition, the mold surface plate 4 keeps thus its form better during the cast.

FIG. 5 also shows an example of fixing the sidewall construction of a casting mold described herein onto a casting bed. In this fixing system, the magnet unit 7 is positioned with respect to the sidewall construction so that the part of the lower horizontal aluminium profile 2 extending outwards from the mold surface, sets itself inside the magnet unit as shown in the figure. The fixed attachment of the magnet unit 7 to the sidewall construction will be secured by means of a driving pin 8 adjusted to go to the lower horizontal aluminium profile 2 through a hole formed thereto. This kind of a magnet unit is described in Patent application FI 20060060.

Figure 6A:
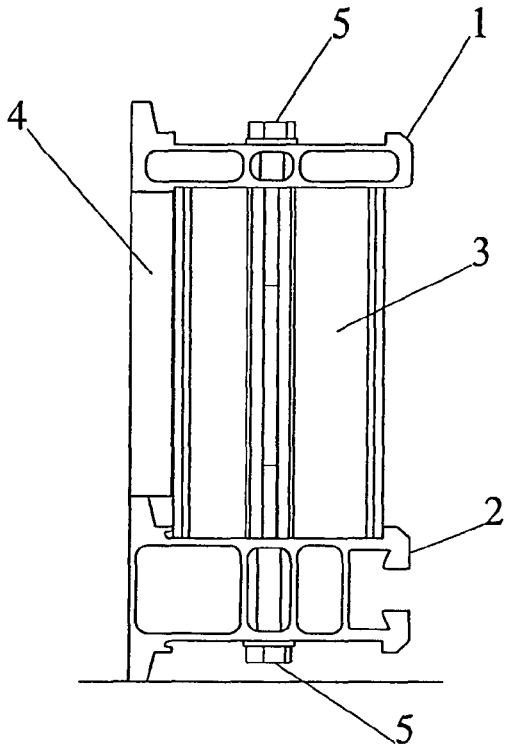
Figure 6B:
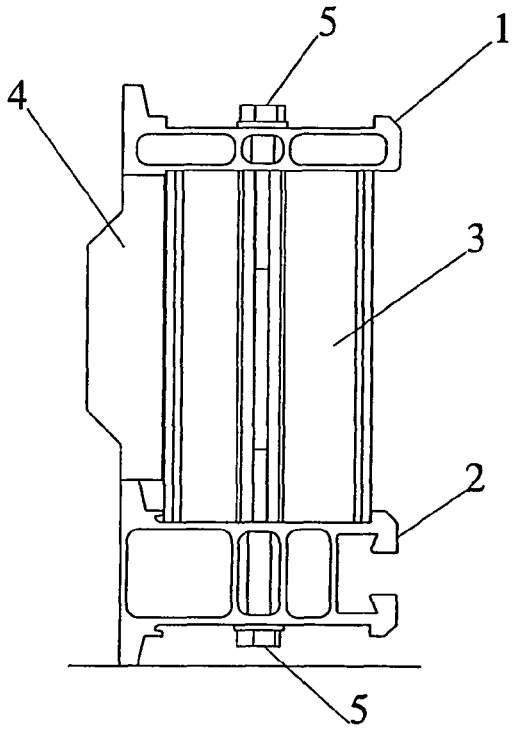

In the examples shown in FIGS. 6A and 6B, the horizontal aluminium profiles 1 and 2 form with their edge surfaces a part of the mold surface that defines the product to be cast. In these solutions, the mold surface plate 4 is interposed between the upper horizontal aluminium profile 1 and the lower horizontal aluminium profile 2 so that the mold surface plate 4 is supported with its back surface on the vertical aluminium profile 3. As shown in FIG. 6B, it is possible with this kind of a solution to shape the surface of the concrete product to be cast defined against the sidewall construction described herein.

With respect to the embodiments shown in FIGS. 2 to 4 it should be appreciated, that the upper and lower horizontal aluminium profile shown therein in each figure are formed of one and the same aluminium profile, whereby one of those profiles has been simply turned over. This kind of a solution decreases the amount of aluminium profile forms needed for the sidewall construction described herein, whereby the economic efficiency further can be improved. It must be appreciated, however, as shown by the solutions of FIGS. 1, 5, 6A and 6B, among others, that the sidewall construction described herein is not limited to those embodiments.

Figure 7:
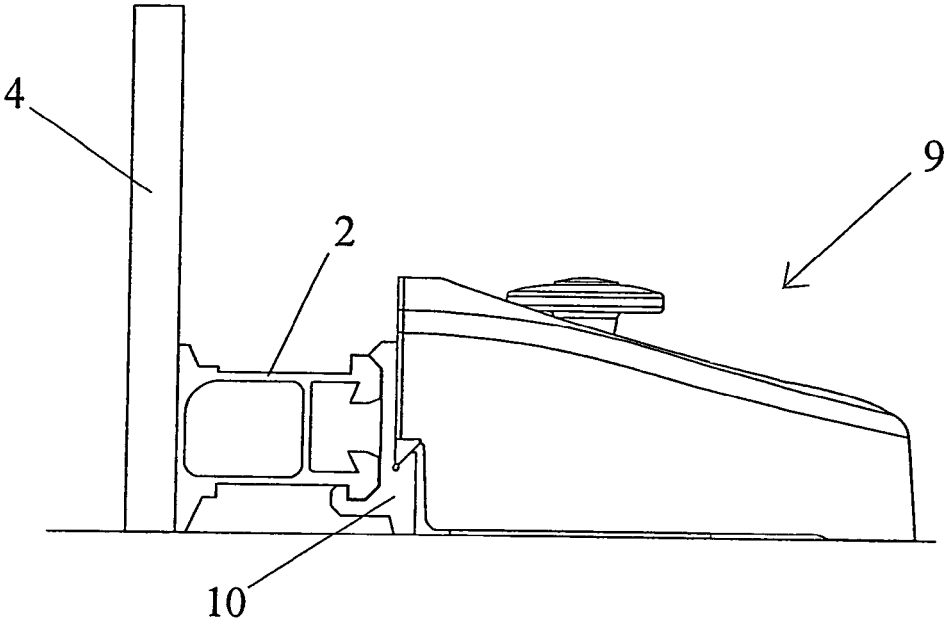
FIGS. 7 and 8 show examples of fixing the sidewall constructions of the casting mold according to embodiments of the casting bed.

FIG. 7 shows one way of fixing the casting mold in accordance with embodiments of the casting bed by means of a magnet unit disclosed in the publication EP-A-1 075 917. For the part of the sidewall construction of the casting mold only the lower horizontal aluminium profile 2 with the mold surface plate 4 attached thereto are shown, being the most essential components of the sidewall construction from the point of view of this fixing solution.

In the fixing solution shown in FIG. 7, a connecting part 10 is placed in interlocking to the outer end of the lower horizontal aluminium profile 2, thus forming a connecting surface with a groove for the magnet unit 9. In the solution according to the figure, also e.g. a bolt connection can be used, if necessary, for improving the attachment of the connecting part 10 to the aluminium profile 2.

Figure 8:
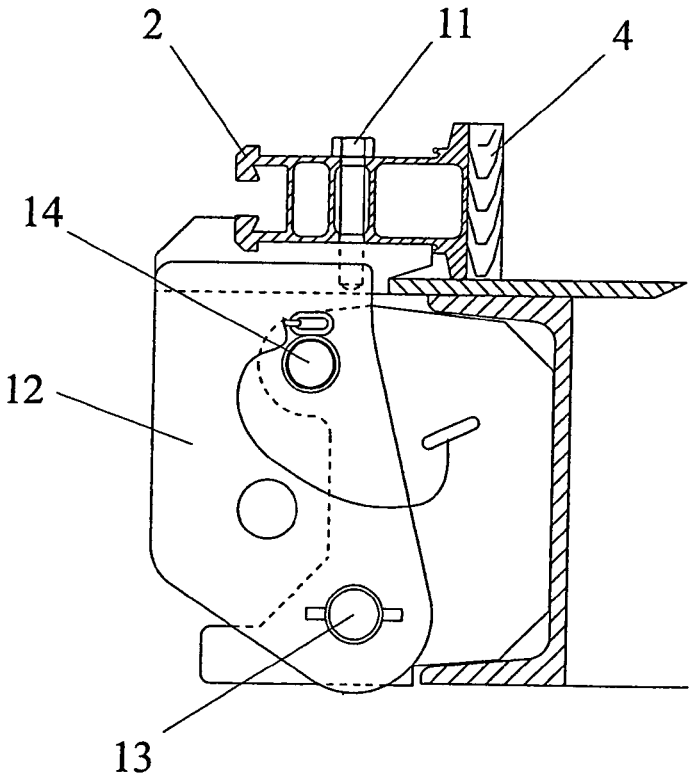

FIG. 8 shows one way for fixing the sidewall construction described herein to the edge of the casting bed. For the part of the sidewall construction of the casting mold only the lower horizontal aluminium profile 2 with the mold surface plate 4 attached thereto are shown, being the most essential components of the sidewall construction from the point of view of this fixing solution.

In the fixing solution of FIG. 8, the sidewall construction of the casting mold is fixed with a fixing bolt 11 to a hinge part 12 being through pin 13 pivotably fixed to the edge of the casting bed. The hinge part is locked in place with a detachable locking pin 14. By detaching the locking pin 14, the hinge part 12 together with the sidewall construction can be turned outwards from the casting bed, whereby the cast product can be removed from the casting bed.

By means of the sidewall constructions described herein and their different fixing solutions, the vertical position of the horizontal aluminium profiles 1 and 2 can be changed, as necessary, so that they can be placed in optimal positions, e.g. for positioning the reinforcing steels of the product to be cast, said steels eventually penetrating the mold surface plates of the casting mold 4, in a desired way to the casting mold.

The sidewall construction described herein provides a lightweight sidewall construction having a simple construction to be used for casting concrete elements, said sidewall construction being easily cleanable and detachable from the casting bed. In addition, the solution described herein provides a simple solution for converting the sidewall construction as necessary, when casting short production runs.

The sidewall construction described herein is in terms of support construction not limited to two vertical aluminium profiles connecting horizontal aluminium profiles. Based on the requirements set to the sidewall construction, the sidewall construction described herein can also be implemented, when necessary, with one vertical aluminium profile, or correspondingly, especially with long sidewall construction, more than two vertical aluminium profiles can be used, when necessary.

The invention having been described above with reference to certain specific embodiments thereof, it will be recognized that these embodiments do not limit the scope of the appended claims.

The invention claimed is:

1. A sidewall construction for casting prefabricated concrete elements, said sidewall construction comprising:

a mold surface plate defining a surface of a concrete element to be cast;

a support construction, wherein the mold surface plate is fixed to the support construction, and, wherein the support construction comprises: two horizontal aluminium profiles each having an opposing inner surface and at least one vertical aluminium profile connecting and extending between said opposing inner surfaces of the two horizontal aluminium profiles; and wherein the mold surface plate is fixed to the support construction by interlocking therewith or by interposing between the two horizontal aluminum profiles.

2. A sidewall construction of a casting mold according to claim 1, wherein at least two vertical aluminium profiles are provided.

3. A sidewall construction of a casting mold according to claim 1, wherein the mold surface plate (4) is fixed to the support construction by interlocking therewith.

4. A sidewall construction of a casting mold according to claim 1, wherein the mold surface plate is interposed between the horizontal aluminium profiles.

5. A sidewall construction of a casting mold according to claim 1, wherein the sidewall construction is fixed to a casting bed by means of a separate magnet unit.

6. A sidewall construction of a casting mold according to claim 5, wherein the side construction is fixed to an edge of the casting bed by means of a part hinged to the casting bed.

7. A sidewall construction of a casting mold according to claim 2, wherein the mold surface plate is fixed to the support construction by interlocking therewith.

8. A sidewall construction of a casting mold according to claim 2, wherein the mold surface plate is interposed between the horizontal aluminium profiles.

9. A sidewall construction of a casting mold according to claim 3, wherein the mold surface plate is interposed between the horizontal aluminium profiles.

10. A sidewall construction of a casting mold according to claim 1, wherein the mold surface plate is made of wooden material, plastic, or metal.

11. A sidewall construction of a casting mold according to claim 2, wherein the sidewall construction is fixed to casting bed by means of a separate magnet unit.

12. A sidewall construction of a casting mold according to claim 3, wherein the sidewall construction is fixed to a casting bed by means of a separate magnet unit.

13. A sidewall construction of a casting mold according to claim 4, wherein the sidewall construction is fixed to a casting bed by means of a separate magnet unit.

14. A sidewall construction of a casting mold according to claim 10, wherein the sidewall construction is fixed to the casting bed by means of a separate magnet unit.

15. A sidewall construction of a casting mold according to claim 2, wherein the side construction is fixed to the edge of the casting bed by means of a part hinged to a casting bed.

16. A sidewall construction of a casting mold according to claim 3, wherein the side construction is fixed to the edge of the casting bed by means of a part hinged to a casting bed.

17. A sidewall construction of a casting mold according to claim 4, wherein the side construction is fixed to the edge of the casting bed by means of a part hinged to a casting bed.

18. A sidewall construction of a casting mold according claim 10, wherein the side construction is fixed to the edge of the casting bed by means of a part hinged to a casting bed.

19. A sidewall construction of a casting mold according to claim 10, wherein the mold surface plate is interposed between the horizontal aluminium profiles.

20. A sidewall construction of a casting mold according to claim 2, wherein the mold surface plate is made of wooden material, plastic, or metal.

* * * * *